US006881113B2

(12) United States Patent
Smith

(10) Patent No.: US 6,881,113 B2
(45) Date of Patent: Apr. 19, 2005

(54) PROPULSION DEVICE FOR USE WITH SWIMMERS

(76) Inventor: R. Evan Smith, P.O. Box 130, Sahuarita, AZ (US) 85629

( * ) Notice: Subject to any disclaimer, the term of this patent is extended or adjusted under 35 U.S.C. 154(b) by 0 days.

(21) Appl. No.: 10/313,885

(22) Filed: Dec. 6, 2002

(65) Prior Publication Data

US 2004/0110436 A1 Jun. 10, 2004

(51) Int. Cl.[7] ..... A63B 31/11
(52) U.S. Cl. ..... 441/61
(58) Field of Search ..... 440/13, 14, 15; 441/55, 60, 61, 62, 63, 64; 21/806

(56) References Cited

U.S. PATENT DOCUMENTS

| | | | | | |
|---|---|---|---|---|---|
| 1,007,867 | A | * | 11/1911 | Halvorsen | 441/62 |
| 1,237,392 | A | * | 8/1917 | Schneider | 441/63 |
| 1,452,790 | A | * | 4/1923 | Claupin | 441/62 |
| 1,702,681 | A | * | 2/1929 | Barbosa | 441/62 |
| 1,745,280 | A | | 1/1930 | Snapp | |
| 3,055,025 | A | * | 9/1962 | Ferraro et al. | 441/64 |
| 3,072,932 | A | * | 1/1963 | Ciccotelli | 441/64 |
| 3,122,759 | A | | 3/1964 | Gongwer | |
| 3,204,262 | A | | 9/1965 | Gongwer | |
| 3,302,223 | A | * | 2/1967 | Ciccotelli | 441/64 |
| 3,665,535 | A | | 5/1972 | Picken | |
| 4,025,977 | A | | 5/1977 | Cronin | |
| 4,342,558 | A | | 8/1982 | Wilson | |
| 4,541,810 | A | | 9/1985 | Wenzel | |
| 4,664,639 | A | * | 5/1987 | Schneider | 441/61 |
| 4,767,368 | A | | 8/1988 | Ciccotelli | |
| 4,781,637 | A | | 11/1988 | Caires | |
| 5,429,536 | A | | 7/1995 | Evans | |
| 6,126,503 | A | * | 10/2000 | Viale et al. | 441/64 |
| 6,290,561 | B1 | * | 9/2001 | Garofalo et al. | 441/64 |
| 6,394,863 | B1 | * | 5/2002 | Chen | 441/64 |

FOREIGN PATENT DOCUMENTS

| | | | | |
|---|---|---|---|---|
| SU | 925354 | * | 5/1982 | 441/64 |

* cited by examiner

*Primary Examiner*—Andrew D. Wright
(74) *Attorney, Agent, or Firm*—Lawrence R. Oremland PC

(57) ABSTRACT

A new and useful propulsion apparatus for use by a swimmer is provided. The propulsion apparatus comprises (a) a support structure configured for connection to a swimmer's foot, and (b) a fin connected with the support structure by a flexible coupling in a manner that enables the fin to be stroked in alternating downstrokes and upstrokes by flexion of a swimmer's knees. The flexible coupling is configured to enable the fin to rotate in a first direction relative to the support structure during a downstroke, and the propulsion apparatus has a mechanical stop for limiting rotation of the fin in the first direction to physically set the angle of attack on the fin during a downstroke. The flexible coupling comprises an elastic suspension extending between the support structure and the fin, the elastic suspension being configured to (a) allow the fin to rotate in a second direction opposite to the first direction during an upstroke and (b) dynamically set the angle of attack during an upstroke.

5 Claims, 6 Drawing Sheets

PROPULSION DEVICE FOR USE WITH SWIMMERS

BACKGROUND

The present invention relates to a propulsion device for a swimmer, and particularly to a propulsion device designed to increase the propulsion efficiency of a swimmer.

In the design of a propulsion device for a swimmer, the applicant feels there are important criteria that need to be considered. For example, efficiency of the device is an important consideration. Specifically, as a swimmer kicks, it is important to provide useful thrust while minimizing drag forces that can cause undesirable resistance. In addition, a propulsion device should exploit the strengths of the swimmer's body and account for its weaknesses. Specifically, the device should account for the strenuous forces and moments that are applied to the swimmer's foot and ankle and also minimize the risk of overworking the hamstring and calf muscles of the swimmer's legs. Thus, it is desirable for the device to not overtax these vulnerable parts of the swimmer's body, while at the same time exploiting strong muscles like the quadriceps.

Thus, a principal objective of the present invention is to provide a swimmer with a propulsion apparatus that takes into account the differences in power available on up-strokes and down-strokes so as not to overtax any of the swimmer's muscle groups. Another objective is to provide a propulsion device designed such that forces and moments applied to the user's feet and ankles by the fin be relatively small to reduce physical strain on the swimmer.

SUMMARY OF THE PRESENT INVENTION

The present invention provides a new and useful propulsion device designed to meet the foregoing criteria. The propulsion device comprises (a) a support structure configured for connection to a swimmer's foot, and (b) a rigid fin connected with the support structure by a flexible coupling in a manner that enables the fin to be stroked in alternating downstrokes and upstrokes by flexion of a swimmer's knees. The flexible coupling is configured to enable the fin to rotate in a first direction relative to the support structure during a downstroke, and the propulsion apparatus has a mechanical stop for limiting rotation of the fin in the first direction to physically set the angle of incidence on the fin, relative to the support structure, during a downstroke.

In its preferred form, the flexible coupling comprises an elastic suspension extending between the support structure and the fin, the elastic suspension being configured to (a) allow the fin to rotate in a second direction opposite to the first direction during an upstroke and (b) dynamically set the angle of attack during an upstroke. The elastic suspension has a flexible center positioned in relation to the chordal center of pressure of the fin such that during an upstroke the resultant fin angle in relation to the fixture is a dynamic response of the hydrodynamic forces on the fin against the elastic fin suspension.

Moreover, a propulsion device according to the preferred embodiment includes a fin with an aspect ratio greater than 6 for optimum efficiency.

Still further, a propulsion device according to the present invention is designed to be simple to make and use.

Further features of the present invention will be apparent from the following detailed description and the accompanying drawings.

DETAILED DESCRIPTION

As described above, the present invention relates to a propulsion device designed to increase the propulsion efficiency of a swimmer. The principles of the present invention are described below in connection with one exemplary version of such a propulsion device. However, from the following description, the manner in which the principles of the present invention can be used to design various types of propulsion devices for swimmers will be apparent to those in the art.

Initially, it is believed useful to describe some factors that applicant considers important in the design of a propulsion device. For example, as described above, as a swimmer kicks, a propulsion device should provide useful thrust while minimizing drag forces that can cause undesirable resistance. In addition, the propulsion device should exploit the strengths of the swimmer's body and account for its weaknesses. Specifically, the device should account for the forces and moments that are applied to the swimmer's foot and ankle and also minimize the risk of overworking the hamstring and calf muscles of the swimmer's legs. Thus, it is desirable for the device to not overtax these vulnerable parts of the swimmer's body, while at the same time exploiting strong muscles like the quadriceps.

When a swimmer is essentially horizontal in the water, upward strokes are made using the hamstrings. The muscles producing the energy for the downward strokes, the quadriceps, are more powerful than those providing the upward strokes. Therefore, it is desirable to set the angles of attack of the fin so that full advantage is taken of the power of the downstroke and the upstroke is manageable by the less powerful muscles used for that stroke. It is also important to understand that effective use of swimming fins requires that the user's feet be held in alignment with the legs as much as possible. This alignment is easy on the downstrokes but requires use of the calf muscles on the upstrokes. This is a further reason for providing for up-stroke angles of attack which ease the forces needed and do not require full extension of the feet, while still providing useful propulsion.

In addition, it is important to take advantage of the efficiencies of a high aspect ratio fin, but also to control the fin's angle of attack to ensure that it stays efficient over a broad range of operation. For purposes of this disclosure, the angle of incidence is the angle between the base of the fixture (which is in contact with the soles of the user's feet) and the chordal plane of the fin, and the angle of attack is the angle between the chordal plane and the direction of the fluid flow toward the leading edge of the fin.

Figure 1:
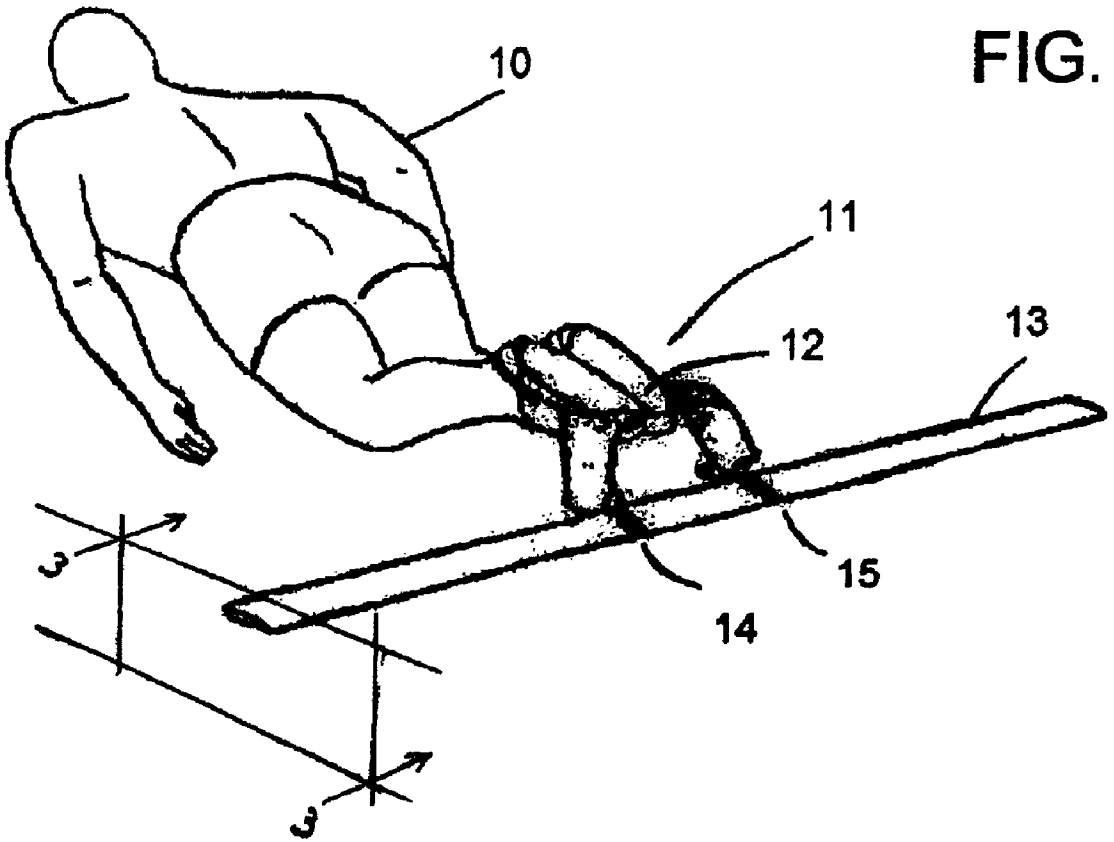
FIG. 1 is a is a schematic illustration of a swimmer using a propulsion device according to the present invention.
Figure 3:
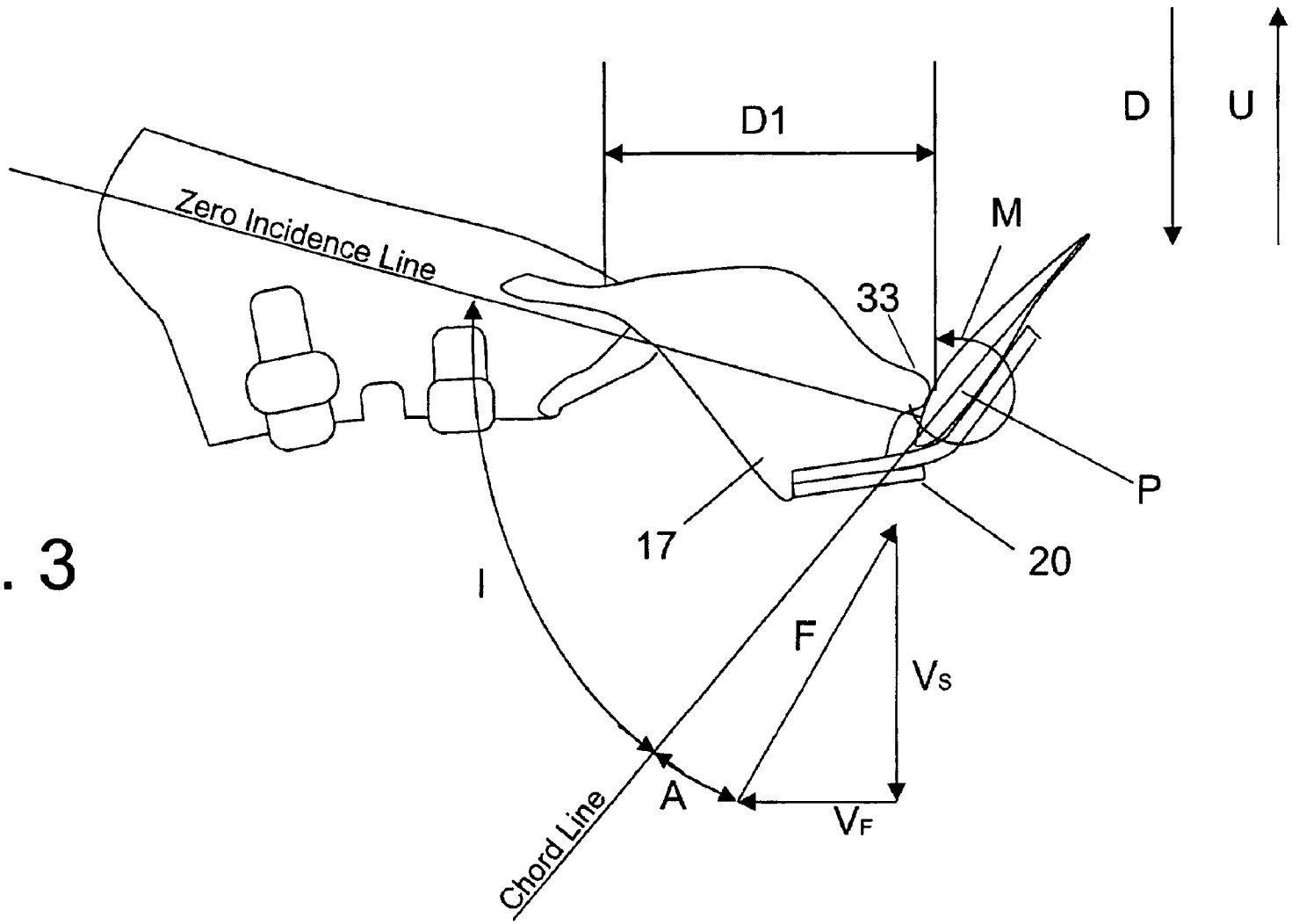
FIG. 3 schematically illustrates a propulsion device of the present invention, during a downstroke.
Figure 4:
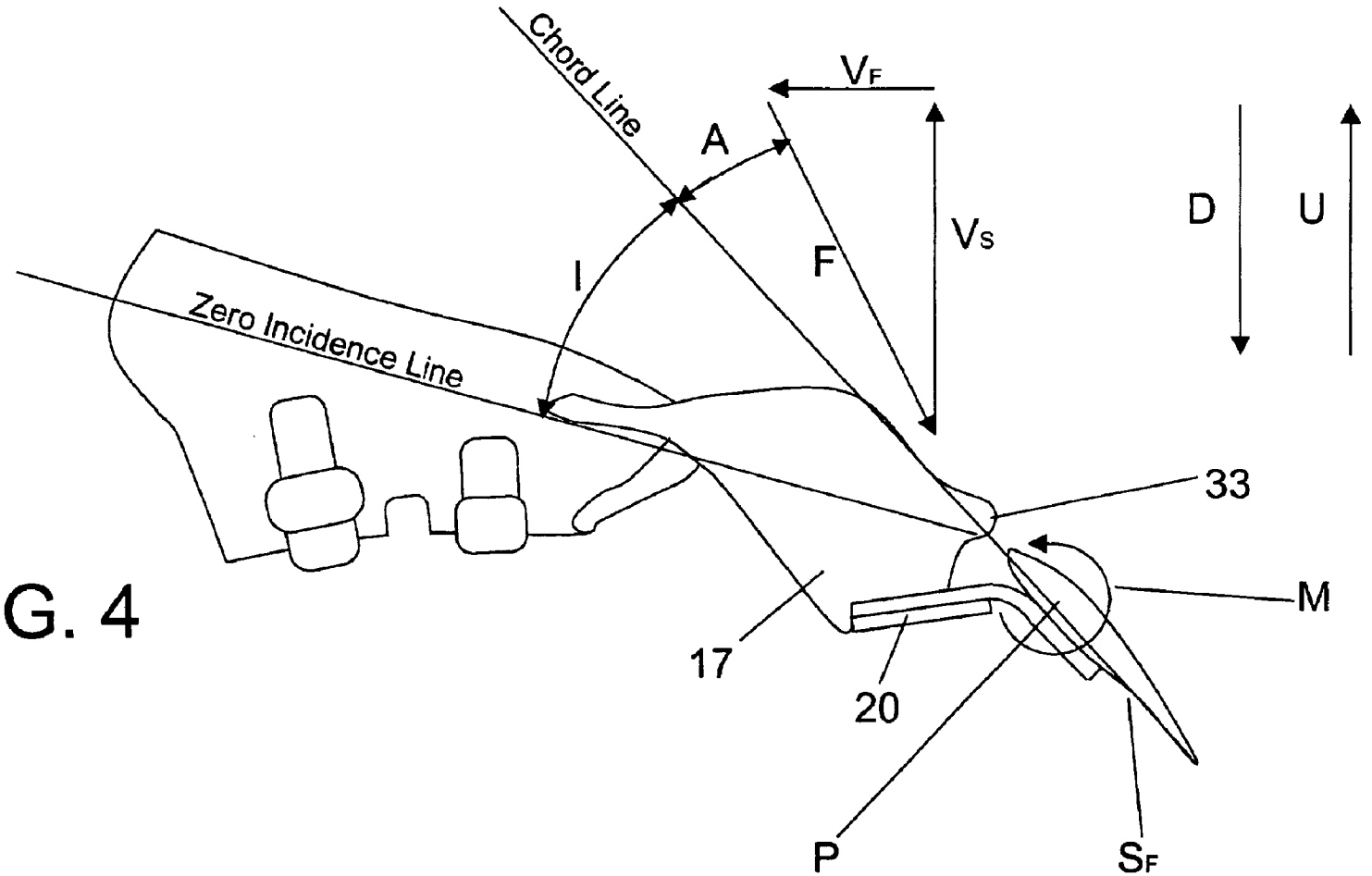
FIG. 4 schematically illustrates a propulsion device of the present invention during an upstroke.

FIG. 1 illustrates a swimmer 10 using a propulsion device 11 according to a preferred embodiment of the present invention. For purposes of this disclosure, the swimmer is illustrated as if horizontal and face down in water and down-strokes move the device in the direction indicated by arrow D (as depicted in FIG. 3) and upstrokes in the direction indicated by arrow U (as depicted in FIG. 4). The propulsion device comprises fixture 12, fin 13 and means for attaching the fin to the fixture; the means in this embodiment comprising flexible straps 14 and 15.

Figure 2:
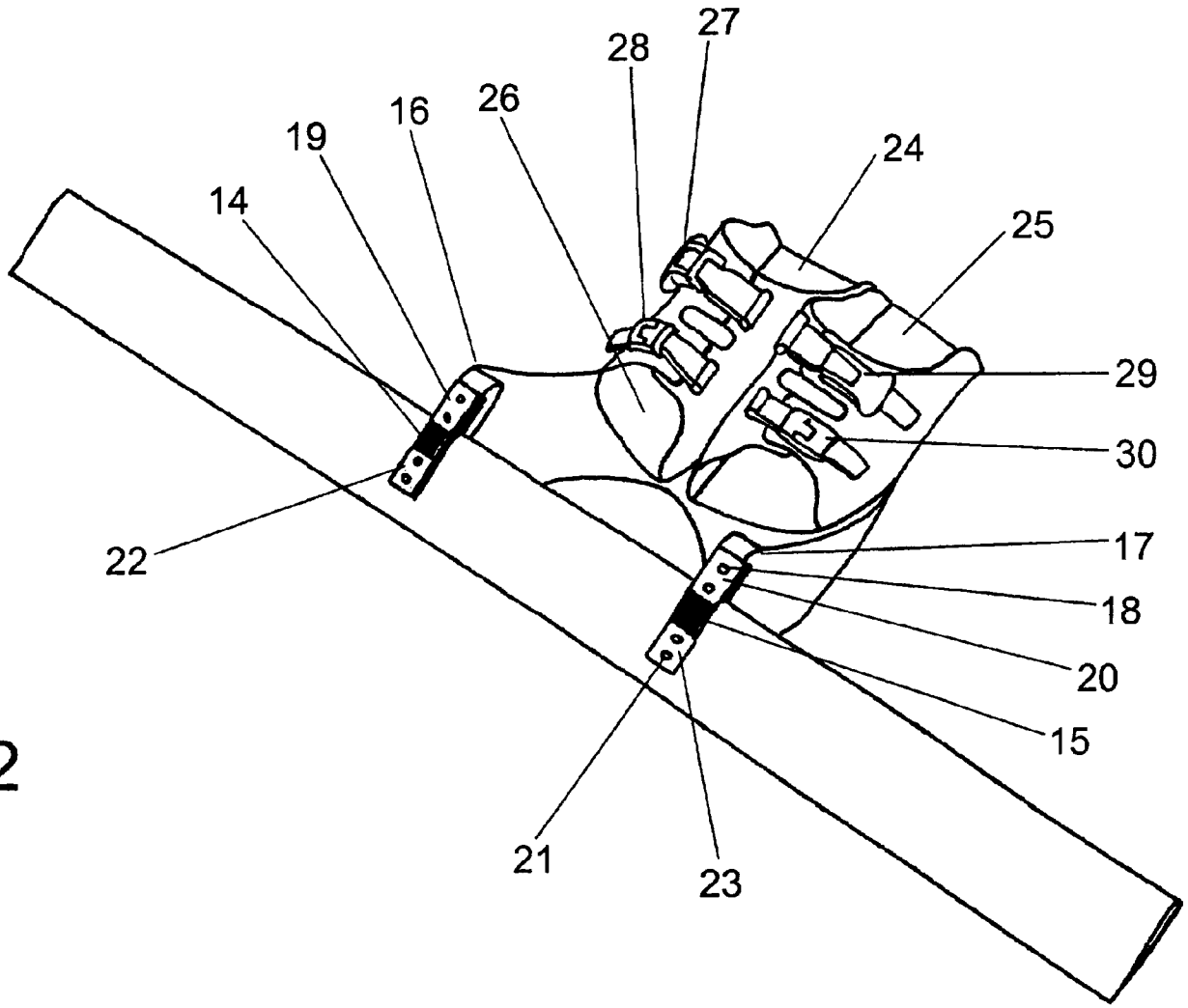
FIG. 2 is a schematic, perspective view of a propulsion device according to the present invention.

FIG. 2 illustrates the propulsion device in more detail. Straps 14 and 15 are attached to support structures 16 and 17, respectively, by fasteners, one fastener shown at 18 being typical, and through clips 19 and 20, which distribute the holding forces of the fasteners over the straps. The straps are similarly attached to the fin 13 by fasteners, of which fastener 21 is typical, and clips 22 and 23. A user's feet fit into passages 24 and 25 in the fixture with the soles of the feet against base 26 of the fixture.

FIG. 3 is a side view of the apparatus taken at 3—3 in FIG. 1. The support structures 16 and 17, strut 17 being shown in FIG. 3, are configured to hold the fin 13 a distance D1 from the user's feet to provide undisturbed water flow to the fin. This view illustrates the apparatus during a down-stroke with the fin forced against stop 33 on strut 17. Angle I is the angle of incidence and angle A is the angle of attack. The direction of water flow relative to the fin 13, indicated by arrow F, is a function of the flow velocity $V_F$ of the swimmer through the water and the stroke velocity of the downward stroke of the feet and apparatus $V_s$. The relationship of $V_F$ to $V_s$ tends to remain fairly constant over typical swimming ranges because as $V_s$ increases, $V_F$ is increased. As shown in FIG. 4, the foil section $S_F$ has camber. This camber generates a hydrodynamic moment indicated by arrow M. This moment helps to hold the fin against the stop 33 during down-strokes and tends to increase the angle of attack during up-strokes.

FIG. 4 is similar to FIG. 3 but illustrates the apparatus during an up-stroke. The various flow directions and angles are lettered the same as in FIG. 3. The angle of attack during up-strokes is a function of the flexibility of the straps coupled with the location of the elastic bending center of the straps in relation to the hydrodynamic center of the fin and the effects of the camber in the foil section, along with the velocity components of the water. The hydrodynamic center of the fin is ¼ of the chord length back from the leading edge of the fin. In the down-stroke the elastic bending center of the strap is moved aft near the hydrodynamic center of the fin by the edge of clips 19 and 20, clip 20 showing in FIG. 4. The lifting force of the fin crossed with the moment arm from the location of the center of pressure P to the elastic bending center of the flexible strap provides a positive moment (+ axis into page and − axis out of page). Add that to the negative moment M and the resultant vector is the torque that is balanced by the elastic deformation of the straps 14 and 15. The hydrodynamic moment M increases with the square of the magnitude of F. Therefore, high-speed swimming will make the up-stroke powerful and effective, but low-speed swimming will reduce the load to alleviate the swimmer's hamstrings to prevent cramps on long swimming excursions. This fin suspension system is self-correcting if the fin begins to stall on up-strokes. This is important because the down-stroke is the dominant power stroke and the fin will likely be optimized for that state, leaving the fin more susceptible to stalling on up-strokes. If the fin stalls, its center of pressure begins to move aft, toward the ½ chord position. This shift increases the lever arm from the center of pressure to the elastic bending center of the flexible straps, which deforms the elastic straps and alleviates the stalled condition.

The center of pressure P on the fin (FIGS. 3 and 4) is only a short distance from the user's toes. Therefore, the moment applied to the user's ankles by the forces on the fin is considerably less than that applied by conventional fins in which the distance D1 is much greater than in the subject apparatus.

In addition, the aspect ratio of the fin is in the range of 6.0 to 12.0. Such a high aspect ratio provides the propulsion device with optimum efficiency.

Figure 5:
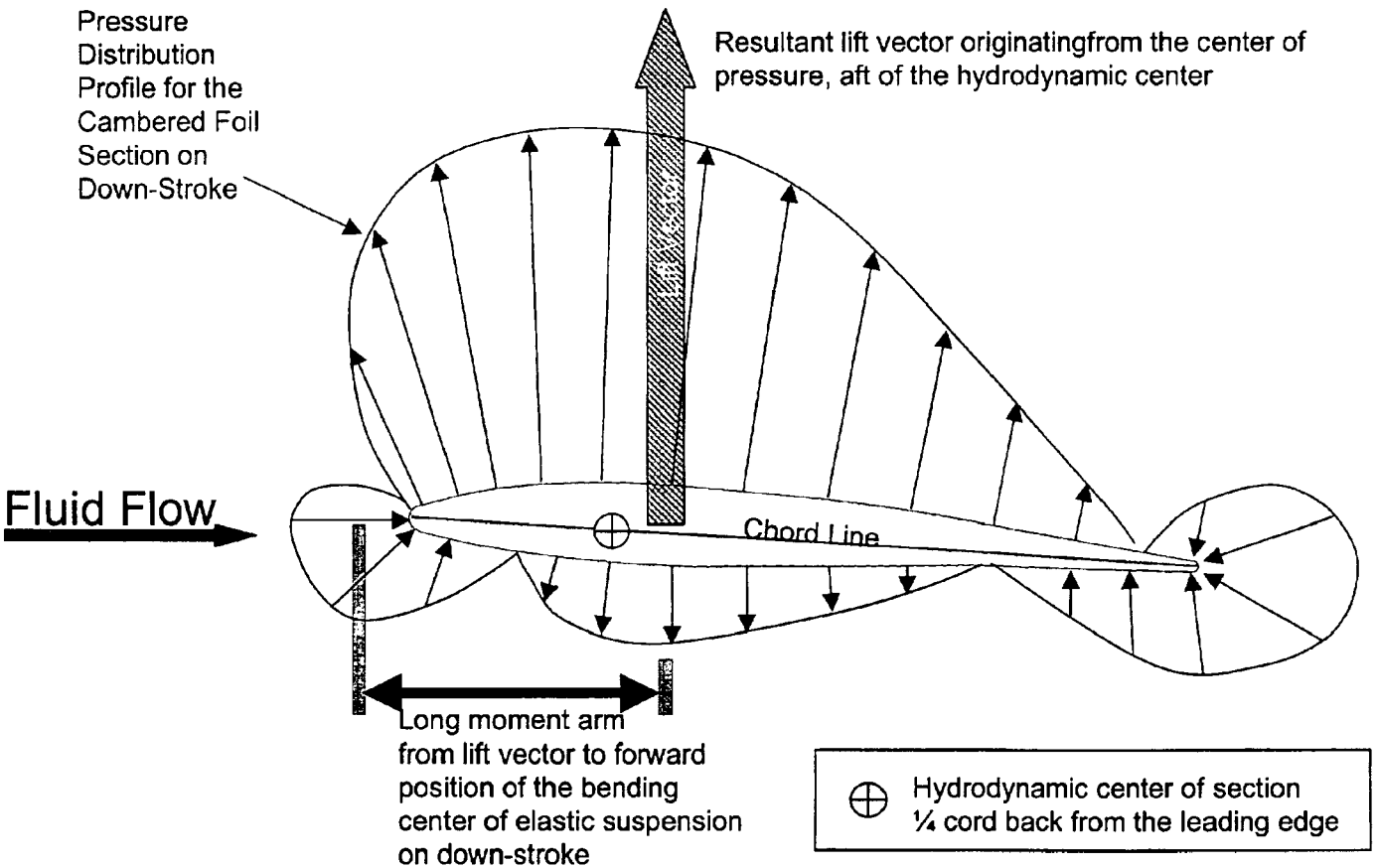
FIG. 5 schematically illustrates the force distribution on a fin in a propulsion device of the invention, during a downstroke.
Figure 6:
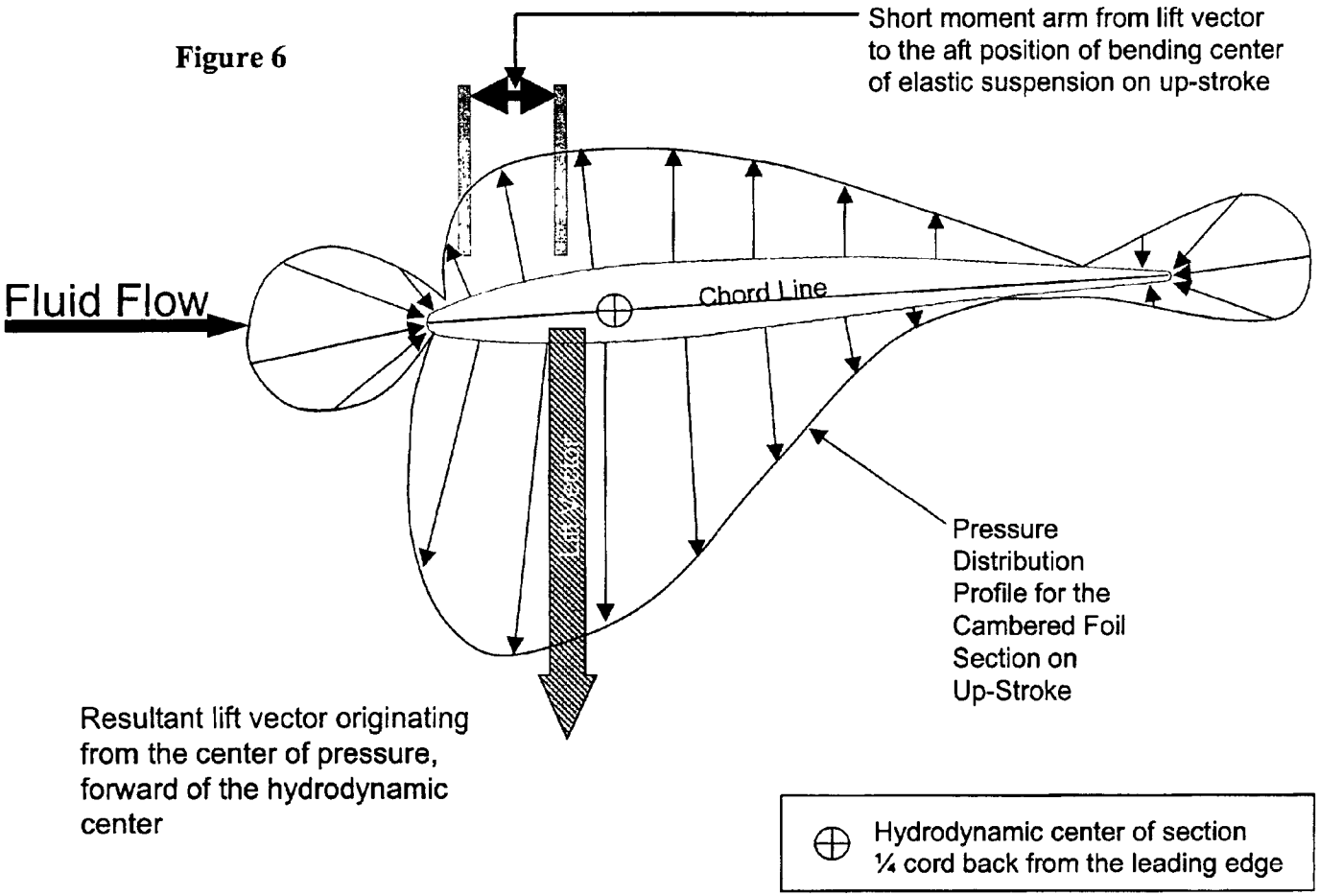
FIG. 6 schematically illustrates the force distribution on a fin in a propulsion device of the invention, during an upstroke.

FIGS. 5 and 6 schematically illustrate the force distribution on a fin in a propulsion device of the invention, during a downstroke (FIG. 5), and during an upstroke (FIG. 6). The manner in which the flexible center of the elastic suspension is forward of the center of pressure of the fin for down-strokes, allowing the fin to rotate with little restraint to the mechanical stop during downstrokes, and the manner in which the flexible center of the fin's elastic suspension moves back near the center of pressure of the fin for up strokes, allowing the elastic forces of the elastic suspension to balance the forces of the fin to set the fin's angle of incidence during upstrokes, can be further appreciated from those figures.

A preferred fin configuration has a span of 3.5 to 4 feet and a fin area of approximately 1.6 square feet. The fin is attached laterally to the fixture with the span of the fin perpendicular to the height of, and in the plane of the shoulders of, the user. The means for attaching the fin to the fixture is such that the angle of incidence during a down-stroke is physically set with the fin coming into contact with a mechanical stop to set the angle of incidence. The angle of incidence is such that the resulting angle of attack produces a high lift to drag ratio, providing maximum or near maximum thrust from the fin relative to the effort used to produce the thrust. The means for attaching the fin to the fixture is also such that during up-strokes the angle of incidence is hydro dynamically set against the fin's elastic suspension system, providing angles of attack, which produce useful thrust, while not over-taxing the muscles used for up-strokes.

As described above, the fin has a hydrofoil section on the leading edge that is effective on up-strokes and down-strokes, i.e. positive and negative angles of attack. Also, it may be cambered near the trailing edge so that it produces a hydrodynamic moment, which tends to rotate it against the angle of incidence limiting stop during the down-strokes and dynamically sets the angle of attack during up-strokes. The addition of this camber will tend to increase the fins effectiveness on both upstrokes and down-strokes. Another advantage to using a cambered fin is that a simple adjustment is attainable by remounting of a cambered fin design, reversing top for bottom. This adjustment can be used to lower the fin's effectiveness making it easier to kick, which may be desirable for swimmers who are smaller than what the fin was designed for.

In the disclosed embodiment, the means for attaching the fin is an elastic suspension system, which comprises two flexible straps spaced five to eight inches apart around the span-wise center of lift of the fin to provide lateral stability to the fin. The flexibility of the straps is such that it allows the fin to move to the mechanical stops, one aligned with each suspension strap, during down-strokes and helps to set the angles of incidence during up-strokes. These straps may incorporate a composite laminate within an elastic matrix for strength. An additional benefit to using a composite within the elastic suspension strap, is that the laminate may be biased toward one bending direction of the strap which allows the suspension to bend more easily in one direction than in the other, such that the elastic forces of the suspension system which balance the forces of the fin to set the fin's angle of incidence on up-strokes may be changed by reversing the top to bottom mounting of the suspension means. In this way the swimmer may select the suspension's orientation to adjust the fin for their particular style of swimming.

Another preferred feature of the fin's suspension is accomplished by the clips, one on either side of each flexible strap, at different lengths, so that the pivot point of the strap is varied with pivot direction rather than fixed in location. This feature may allow the flexible center of the fin's elastic suspension to be substantially forward of the chordal center of pressure of the fin for down-strokes allowing the fin to rotate with little restraint to the mechanical stop. Also, by allowing the flexible center of the fin's elastic suspension to move back near the center of pressure of the fin for up-strokes, the elastic forces of the suspension system may sufficiently balance the forces of the fin to set the fin's angle of incidence for up-strokes. Alternately, the same mechanical effect can be accomplished by bonding the flexible strap to the fixture, such that the fixture extends beyond the bond joint, so that in one direction the flexible strap bends from the bonding joint, and in the other direction it bends around the end of the fixture.

Also, in the preferred embodiment, the leading edge of the fin may be notched where it passes over the flexible straps. This will allow the pivot point of the fin, for rotations against the mechanical stop, to be closer to the center of pressure of the fin, thus minimizing mechanical backlash of the fin when the stroke changes in direction. Alternately, if the fin is not notched, it may be easier to manufacture the part as a straight extrusion, which may substantially reduce manufacturing costs. The losses incurred from not notching the wing are small as the backlash is still relatively insignificant.

Still further, in the preferred embodiment, the means for attaching the fin to a swimmer's feet would include plastic or rubber straps or pockets. Alternately, the straps could be made of other materials, including textiles.

In addition, in an alternate embodiment of the invention two fins and two fixtures can be used, one set on each foot. In that embodiment, the spans and aspect ratios of the fin will naturally be lower.

The mechanical stops, which limit the fin's rotation for down-strokes, may be made adjustable to accommodate different fins, and/or swimming styles, with one fixture.

Moreover, surface features that cause early transition from laminar to turbulent flow on the fin may be beneficial because they can delay flow separation at large angles of attack, given the low Reynolds numbers at which the fin operates. Flow separation seriously decreases the hydrodynamic efficiency of the fin and must be avoided to realize the benefits of the subject invention.

Accordingly, from the foregoing description, it will be understood by those in the art that a propulsion device according to the principles of the present invention provides an efficient propulsion device for a swimmer. The apparatus allows for the differences in power available for up-strokes and down-strokes. It will also be understood by those in the art that other embodiments and modifications of those described are possible within the scope of the invention, which is limited only by the attached claims.

What is claimed is:

1. A propulsion apparatus for use by a swimmer, comprising (a) a support structure configured for connection to the swimmer's foot, and (b) a rigid fin connected with the support structure by a flexible coupling in a manner that enables the fin to be stroked in alternating downstrokes and upstrokes by flexion of the swimmer's knees;

the flexible coupling configured to enable the fin to rotate in a first direction relative to the support structure during a downstroke, and the propulsion apparatus having a mechanical stop disposed to engage the fin as the fin rotates in the first direction and to limit rotation of the fin in the first direction to physically set the angle of incidence on the fin during a downstroke;

wherein the flexible coupling comprises an elastic suspension extending between the support structure and the fin, the elastic suspension configured to (a) allow the fin to rotate in a second direction opposite to the first direction during an upstroke and (b) co-operate with the fin to dynamically set the angle of attack during an upstroke, and wherein the fin has a hydrofoil configuration and the elastic suspension has a flexible center positioned in relation to the chordal center of pressure of the fin such that during an upstroke the resultant fin angle in relation to the support structure is a dynamic response of the hydrodynamic forces of the fin acting against the elastic suspension; and wherein the fin and the elastic suspension are configured such that (a) the flexible center of the elastic suspension is forward of the center of pressure of the fin for down-strokes allowing the fin to rotate with little restraint to the mechanical stop during downstrokes, and (b) the flexible center of the elastic suspension moves back near the center of pressure of the fin for up strokes allowing the elastic forces of the elastic suspension to balance the forces of the fin to set the fin's angle of incidence during upstrokes.

2. A propulsion apparatus for use by a swimmer, comprising (a) a support structure configured for connection to the swimmer's foot, and (b) a rigid fin connected with the support structure by a flexible coupling in a manner that enables the fin to be stroked in alternating downstrokes and upstrokes by flexion of the swimmer's knees;

the flexible coupling configured to enable the fin to rotate in a first direction relative to the support structure during a downstroke, and the propulsion apparatus having a mechanical stop disposed to engage the fin as the fin rotates in the first direction and to limit rotation of the fin in the first direction to physically set the angle of incidence on the fin during a downstroke;

wherein the flexible coupling comprises an elastic suspension extending between the support structure and the fin, the elastic suspension configured to (a) allow the fin to rotate in a second direction opposite to the first direction during an upstroke and (b) co-operate with the fin to dynamically set the angle of attack during an upstroke, and wherein the fin has a hydrofoil configuration and the elastic suspension has a flexible center positioned in relation to the chordal center of pressure of the fin such that during an upstroke the resultant fin angle in relation to the support structure is a dynamic response of the hydrodynamic forces of the fin acting against the elastic suspension; and wherein the fin and the elastic suspension are configured such that (a) the hydrodynamic moment of the fin will rotate the fin toward the mechanical stop during downstrokes, and (b) the center of pressure of the fin moves forward of the hydrodynamic center of the fin, near the flexible center of the elastic suspension, for up-strokes, thereby allowing the elastic forces of the elastic suspension to balance the forces of the fin to set the fin's angle of incidence during upstrokes.

3. A propulsion apparatus as set forth in any of claims 1 or 2, wherein the fin has camber configured to create a hydrodynamic moment that tends to rotate the fin toward the mechanical stop.

4. A propulsion apparatus as set forth in claim 3, wherein the fin has an aspect ratio of at least 6.

5. A propulsion apparatus as set forth in any of claims 1 or 2, wherein the fin has an aspect ratio of at least 6.

* * * * *